US005791587A

United States Patent [19]

Pasquale

[11] Patent Number: 5,791,587

[45] Date of Patent: Aug. 11, 1998

[54] APPARATUS AND METHOD FOR TRANSFERRING A FEEDING WEB FROM A FILLED TAKEUP CORE TO AN EMPTY TAKEUP CORE

[75] Inventor: Robert A. Pasquale, Hawthorne, N.J.

[73] Assignee: New Era Converting Machinery, Inc., Patterson, N.J.

[21] Appl. No.: 824,145

[22] Filed: Mar. 25, 1997

[51] Int. Cl.[6] ..... B65H 35/08; B65H 35/04

[52] U.S. Cl. ..... 242/527.1; 242/527.6; 242/527.7

[58] Field of Search ..... 242/527.1, 527.5, 242/527.6, 527.7, 527.2

[56] References Cited

U.S. PATENT DOCUMENTS 4,404,880 9/1983 DeLuca ..... 242/527.1 X

*Primary Examiner*—John Q. Nguyen
*Attorney, Agent, or Firm*—Morrison Law Firm

[57] ABSTRACT

Apparatus for transferring a web moving in a guided and supported web feeding course traversing around a rotary frame and passing therefrom to and winding as a web stock on a first core at a winding station proximal a rotary frame periphery is provided with a rotary circular cutter on the rotary frame that cuts the moving web crosswise of the web travel. Prior to cutting the web the first core is moved away from the winding station and replaced thereat with an empty takeup core. The rotary frame is then rotationally speeded up so that its periphery at which a frame carried web contact shoe and rotary cutter can be positioned move in tandem with the web. The web contact shoe can then be brought into contact with the web to hold it and the circular cutter is operated to cut the feeding web. A trailing end of a part of the web downstream of the cut continues on to windup on the first core. A leading end of the part of the web upstream remains held by the contact shoe. The contact shoe following web cutting is stroked outwardly slightly of the rotary frame periphery so that as the contact shoe passes proximal a periphery of the empty core, the leading end of the web contacts the empty core periphery and starts to wind on the core periphery, this thereby accomplishing transfer of the feeding web to the core winding operation.

14 Claims, 9 Drawing Sheets

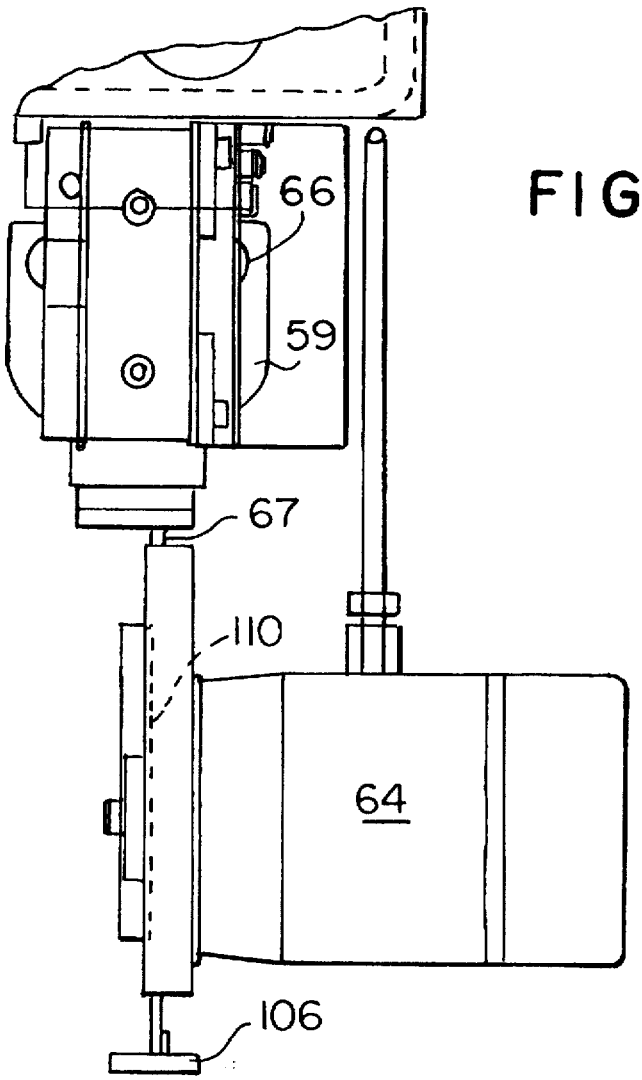
FIG. 8
FIG. 11
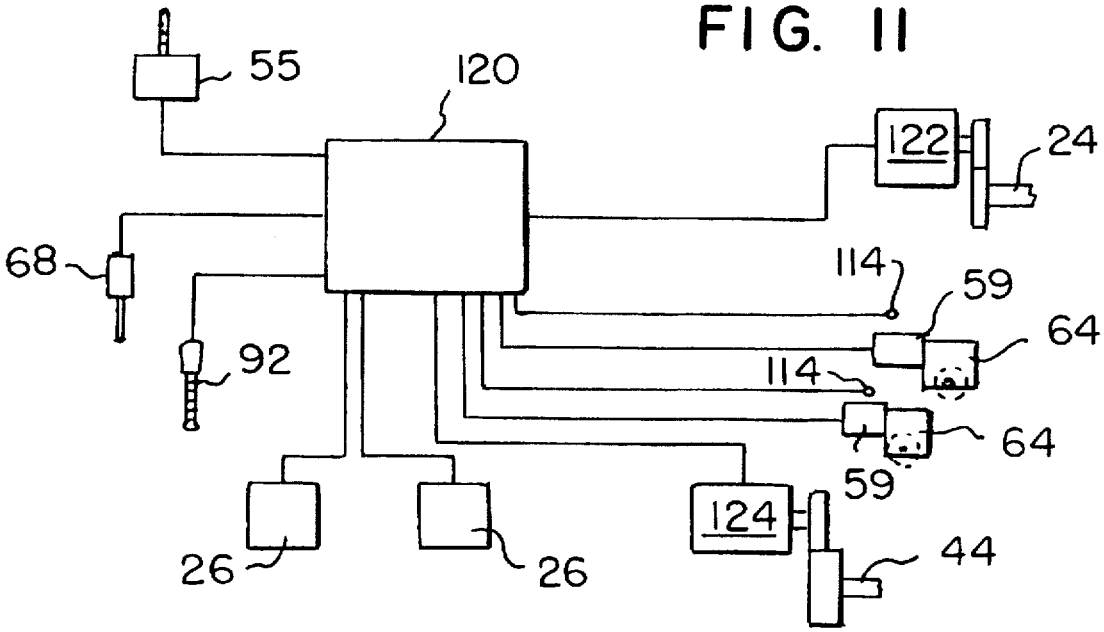

APPARATUS AND METHOD FOR TRANSFERRING A FEEDING WEB FROM A FILLED TAKEUP CORE TO AN EMPTY TAKEUP CORE

BACKGROUND OF THE INVENTION

The present invention relates to web winding apparatus and, more particularly, to web winding apparatus which operates after a winding core is filled with wound web from a feeding web source, to move the filled core away from a winding station, cut the continuous web and then pass a leading end of the cut upstream part of the feeding web onto an empty takeup core present at the winding station for continuing winding of the feeding web.

Apparatus for winding a feeding web onto a core member, cutting the feeding web when the core member is fully wound with web and then transferring the feeding web to a new empty core member is known, U.S. Pat. Nos. 3,128,057; 3,549,097 and 3,552,670 disclosing examples of such apparatus.

A drawback of apparatus of the above types is use of rotary shear cutting and burst knife cutting of the web incident making transfer. A number of types of web materials resist rotary shear cutting and burst knife cutting with the result that the web cut can be irregular or uncuttable so that passing the leading end of the cut web onto an empty core is not effectively achieved and as a consequence, improperly wound stock results or disruption of smooth changeover from filled to empty core winding results to the extent that the production line must be stopped to rectify the cause of interruption.

Problems commonly attend transfer of a web from one to another core where there is intervening web rotary shear cutting in instances where the web is nylon of 10+ mils thickness, fabric, film coated, a foam, is laminated or is of stretchable character.

It is therefor desirable that apparatus and method be provided for transferring a feeding web from a filled takeup core to an empty takeup core that are specially adapted for use with difficult-to-cut materials.

OBJECTS AND SUMMARY OF THE INVENTION

Accordingly, it is an object of the invention to provide apparatus for transferring a feeding web from a filled takeup core to an empty takeup core which overcomes the drawbacks of the prior art.

It is a further object of the invention to provide apparatus for transferring a feeding web winding onto a filled first takeup core to a second empty takeup core which allows for cutting the feeding web and effecting transfer without need to stop operation of the apparatus.

It is a still further object of the invention to provide apparatus for transferring a feeding web winding on a first takeup core to a second empty takeup core which is particularly intended for such where the feeding web is of a difficult-to-cut type material, such as heavy nylon, fabric, a thick laminate, a foam product, a film coated product, a stretchable fabric and similar materials which are not responsive to rotary shear cutting and burst knife cutting.

Briefly stated, there is provided apparatus for transferring a web moving in a guided and supported web feeding course traversing around a rotary frame and passing therefrom to and winding as a web stock on a first core at a winding station proximal a rotary frame periphery. A rotary circular cutter is on the rotary frame and it is used to cut the moving web crosswise of the web travel. Prior to cutting the web, the first core is moved away from the winding station and replaced thereat with an empty takeup core. The rotary frame is then rotationally speeded up so that its periphery at which a frame carried web contact shoe can be positioned, can move in tandem with the web along with the circular cutter. The web contact shoe is then moved into contact with the web to hold it. The circular cutter is then operated traversing to cut the feeding web. A trailing end of a part of the web downstream of the cut continues on to windup on the first core. A leading end of the part of the web upstream remains held by the contact shoe. The contact shoe following web cutting is stroked outwardly slightly of the rotary frame periphery so that as the contact shoe passes proximal a periphery of the empty core the leading end of the web contacts the empty core periphery and starts to be wound on the core periphery, this thereby accomplishing transfer of the feeding web to the core for continuing web winding operation.

In accordance with these and other objects of the invention, there is provided apparatus for transferring a web moving in a guided and supported web feeding course to and winding as a web stock on a first takeup core to a second empty takeup core when the web stock on the first core is at a full wound condition. The apparatus comprises a winding unit having means for rotatably supporting said first takeup core at a winding station and said second takeup core at a standby station. The rotatably supporting means includes means to rotate the first and second takeup cores independently of each other. A web cutting and transfer unit is provided, the web cutting and transfer unit including a rotary frame and a plurality of web support elements spaced about a periphery of the rotary frame. At least a part of the web feeding course traverses the web support elements, the rotary frame being rotatable about an axis transverse to the at least a part of said web feeding course. The web cutting and transfer unit further includes web cutting means and a mounting on said rotary frame carrying this cutting means, the mounting carrying a web contact shoe, the web cutting means being carried on the mounting adjacent the web contact shoe in a position leading the contact shoe in a rotation direction of the rotary frame. The mounting is operable to move radially toward and away from the rotary frame axis to correspondingly move the web contact shoe into and out of contact with the web as it traverses the web support elements and correspondingly to move the cutting means into and out of a web cutting position, the cutting means further being carried on the mounting so as to move in a cutting travel course extending parallel to the axis and between opposite ends of said rotary frame. The winding unit includes means for displacing the first takeup core from the winding station when the web stock thereon is at full wound condition and for advancing the second empty takeup core from the standby station to the winding station. The web cutting and transfer unit is movable between first and second operating positions, the at least a part of said web feeding course when the web cutting and transfer unit is in first operating position being located remote from said winding station, the at least a part of said web feeding course when the web cutting and transfer unit is in second operating position passing closely adjacent a periphery of the empty takeup core at the winding station. Means are provided for rotating the rotary frame to a speed wherein a periphery line speed of the rotary frame is substantially the same as a line speed of the feeding web so that when the mounting is moved radially away from the rotary frame axis to move the web contact shoe into contact with the web, the contact shoe moves in tandem with the web along said at least a part of said web feeding course. An interior of the web contact shoe is connected with a source of vacuum, the web contact shoe having an exterior contact face communicating with the web contact shoe interior so that the feeding web is held against the web contact shoe exterior face by influence of the vacuum. The cutting means which moves circularly in tandem with the web and when in its cutting position and is moved in cutting travel from one rotary frame end to the opposite rotary frame end, cuts the feeding web crosswise to the at least a part of said web feeding course leaving a web trailing end on a downstream part of the feeding web and a web leading end on an upstream part of the web, the web leading end being held against the web contact shoe contact face. A stroking member is carried on the mounting and connected to the web contact shoe for stroking the web contact shoe radially outwardly from the mounting when the web contact shoe passes proximal a periphery of the empty takeup core to move the web leading end into contact with the periphery part of the takeup core to start a winding thereon and thereby to transfer the web leading end to the takeup core. The stroking member can be operated to return stroke the web contact shoe radially toward the mounting following transfer of the feeding web leading end to the takeup core.

According to a feature of the invention, there is further provided a method for transferring a web moving in a guided and supported web feeding course traversing around a rotary frame and passing therefrom to and winding as a web stock on a first takeup core at a winding station proximal a periphery of said rotary frame to a second empty takeup core when the web stock on the first core is at a full wound condition. The method comprises displacing the first takeup core from the winding station while maintaining web winding thereon and moving the empty takeup core to the winding station. The rotary frame is rotated to provide it with a speed at the periphery thereof that matches a line speed of the moving web so that a rotary cutter and a web contact shoe carried on the rotary frame can be moved to position them proximal the said rotary frame periphery and move in tandem with the moving web so the web contact shoe can be brought into contact with the web and the web held to a face of the web contact shoe under the influence of a condition of vacuum present at said face. The rotary cutter then is operated to cut the moving web along a cutting course crosswise to a direction of web movement and with the cutter positioned in advance of the position of the web contact shoe so that a leading end of the web part upstream of the cutting course is held at the face of the web contact shoe. The web contact shoe is advanced radially of the rotary frame to position the web contact face thereof beyond the rotary frame periphery so that as the web contact shoe contact face thereafter passes proximal an outer periphery of the empty takeup core, the web leading end contacts the takeup core periphery for the transferring of a feeding of the upstream web part to the takeup core for winding thereon.

The above, and other objects, features and advantages of the present invention will become apparent from the following description read in conjunction with the accompanying drawings, in which like reference numerals designate the same elements.

BRIEF DESCRIPTION OF THE DRAWINGS

FIG. 8 is a fragmentary front elevational view on enlarged scale showing details of the rotary blade cutter and how it is mounted for movement on the track in the rotary frame extending parallel to the rotary frame axis;

FIG. 11 is a diagrammatic showing of a control arrangement for controlling apparatus operation.

DETAILED DESCRIPTION OF THE PREFERRED EMBODIMENT

The apparatus and method of the invention is described in terms of use in transferring a difficult-to-cut material feeding web from a filled core to an empty takeup core. However, as a person skilled in the art will understand, same could be used with transfer of webs of other material types as well.

Figure 1:
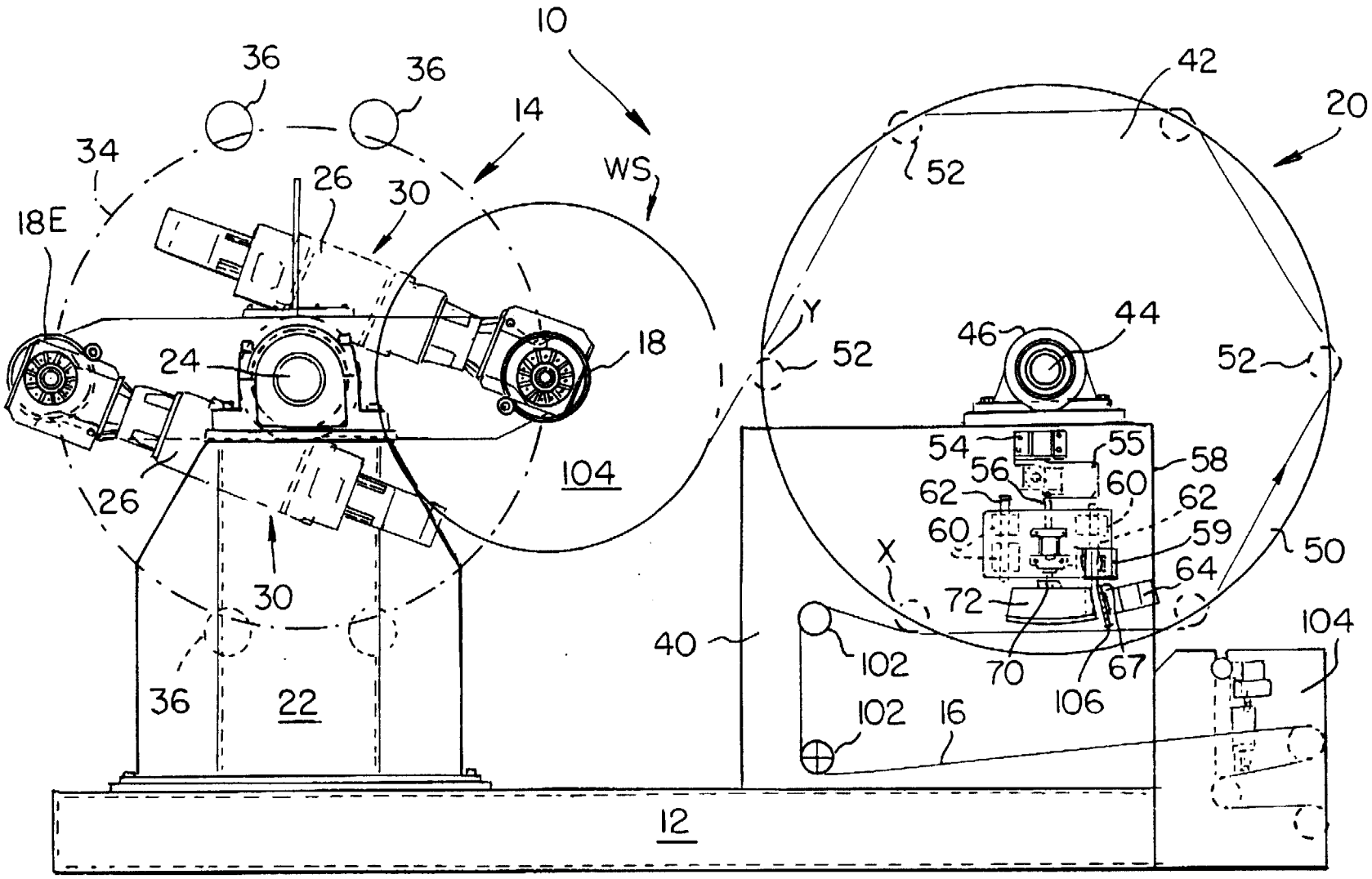
FIG. 1 is a side elevational schematic depiction of the apparatus of the invention showing the condition wherein a first takeup reel is winding feeding web thereon and the wound stock of web is at a predetermined thickness necessitating that the filled reel be moved from the winding station, the feeding web be cut and the feeding web transferred onto an empty takeup core moved into position at the winding station.
Figure 2:
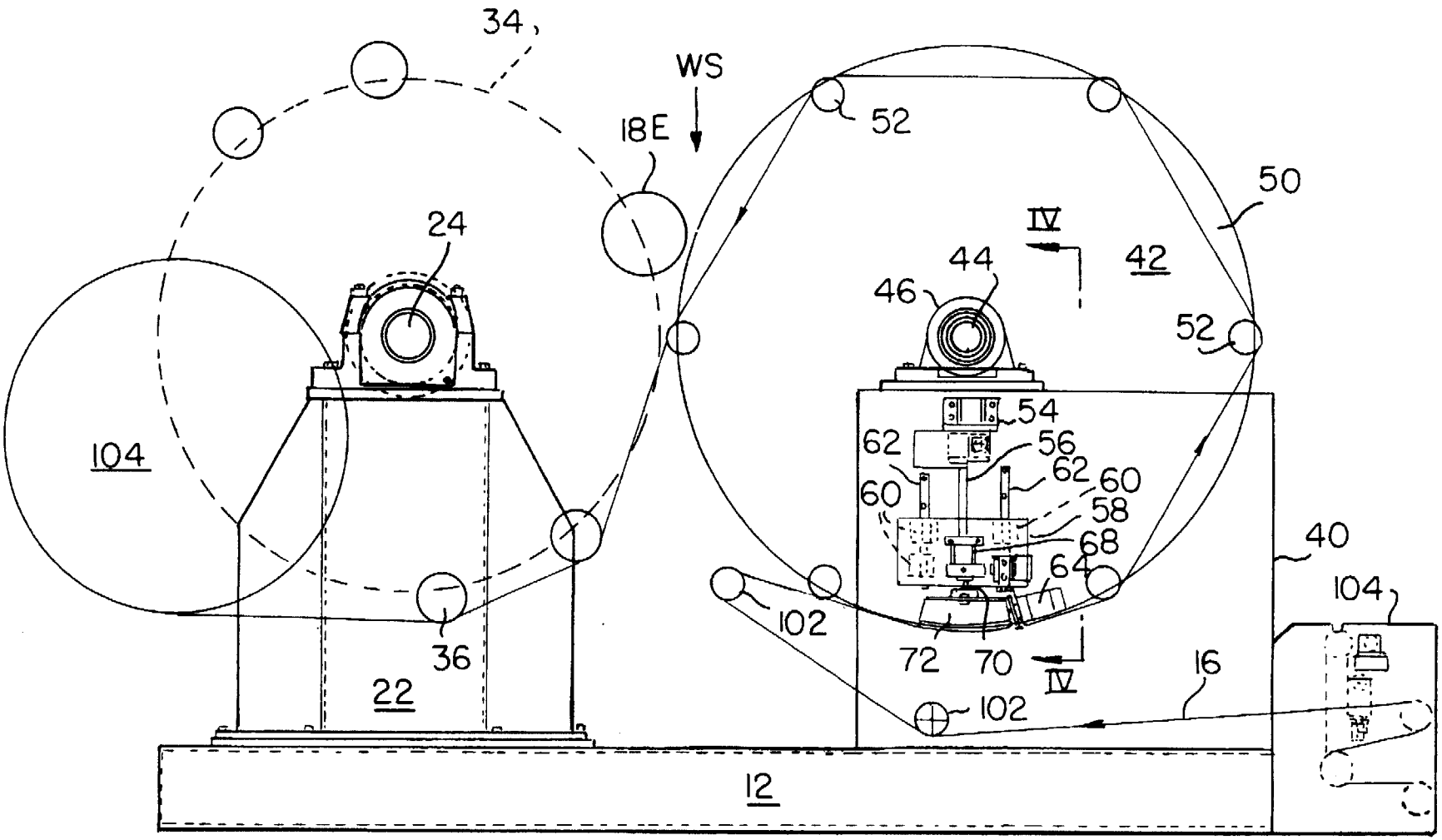
FIG. 2 is a view the same as FIG. 1 except showing the condition after the rotary frame has been speeded up to give it peripheral speed the same as the feeding web line speed, the web contact shoe being shown in position to which it was moved for web contact after the speed up was achieved.
Figure 3:
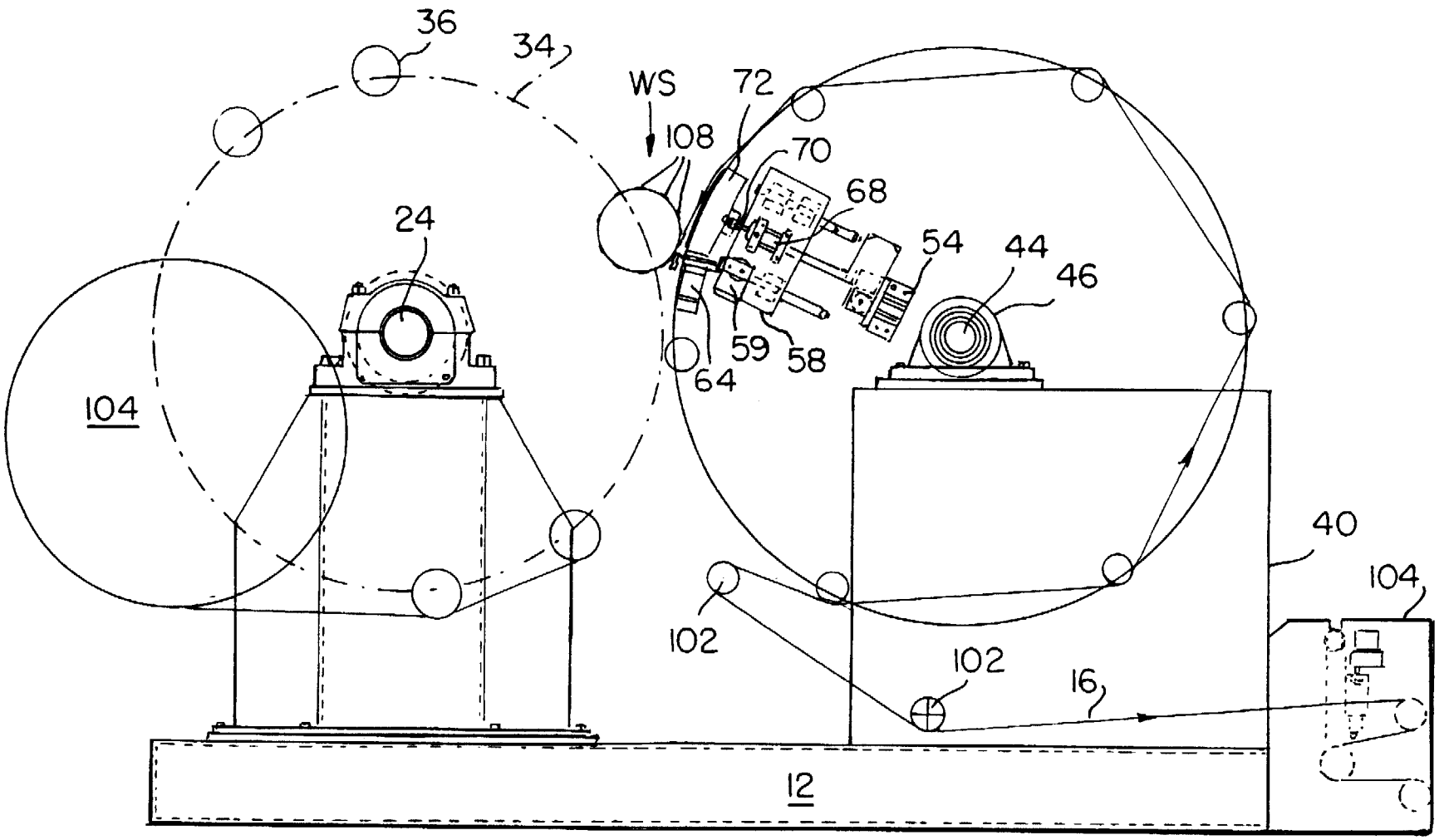
FIG. 3 is a view like FIG. 2 except showing the condition wherein the rotary frame has rotated from the FIG. 2 position to bring the web contact shoe proximal the periphery of the empty takeup core just prior to transferring the leading web end onto the takeup core periphery, the web having been cut during that rotary frame rotation, the web contact shoe having been projected radially slightly beyond the rotary frame periphery to facilitate locating the cut web leading end to contact the empty takeup core in pass by of the web contact shoe.

With continuing reference to FIGS. 1–3, the apparatus 10 includes a suitably structured base 12 on which will be mounted a winding unit 14 for winding feeding web 16 from an upstream located web stock (not shown) onto a takeup core 18, and a web cutting and transfer unit 20 used to effect feeding web cutting and transfer of a leading end of the feeding web remaining upstream of the web cut point onto an empty takeup core 18E which has been moved from a standby station to replace a filled up takeup core at a winding station WS (FIG. 2).

Winding unit 14 includes pedestal 22 having a trunnion supported rotatable central shaft 24. Mounted to the shaft for unitary rotative movement therewith are a pair of winder assemblies 30. Each winder assembly 30 mounts a mandrel on which can be carried a core member 18, the mandrels and hence, core members 18, being disposed parallel to the axis of shaft 24, the arrangement being further that the two mandrels and core members 18 are at locations one reciprocal to the other. Each winder assembly has a winding motor 26 to rotate its associated mandrel and thereby effect web winding on the core mounted on the mandrel. Opposite end plates 34 (shown in phantom outline) are included in the winding unit 14 and mounting brackets (not shown) carry a number of web guiding rollers 36 at the plate circumferential peripheries.

The web cutting and transfer unit 20 includes a pair of spaced apart piers 38, 40 (FIG. 4) on which is set a rotary frame 42, the rotary frame having a central shaft 44 which has its opposite ends supported in bearing blocks 46 which in turn rest on top of the piers, the bearing blocks and, hence, the rotary frame being slidably movable along the pier tops in manner and for purpose to be discussed later.

Figure 4:
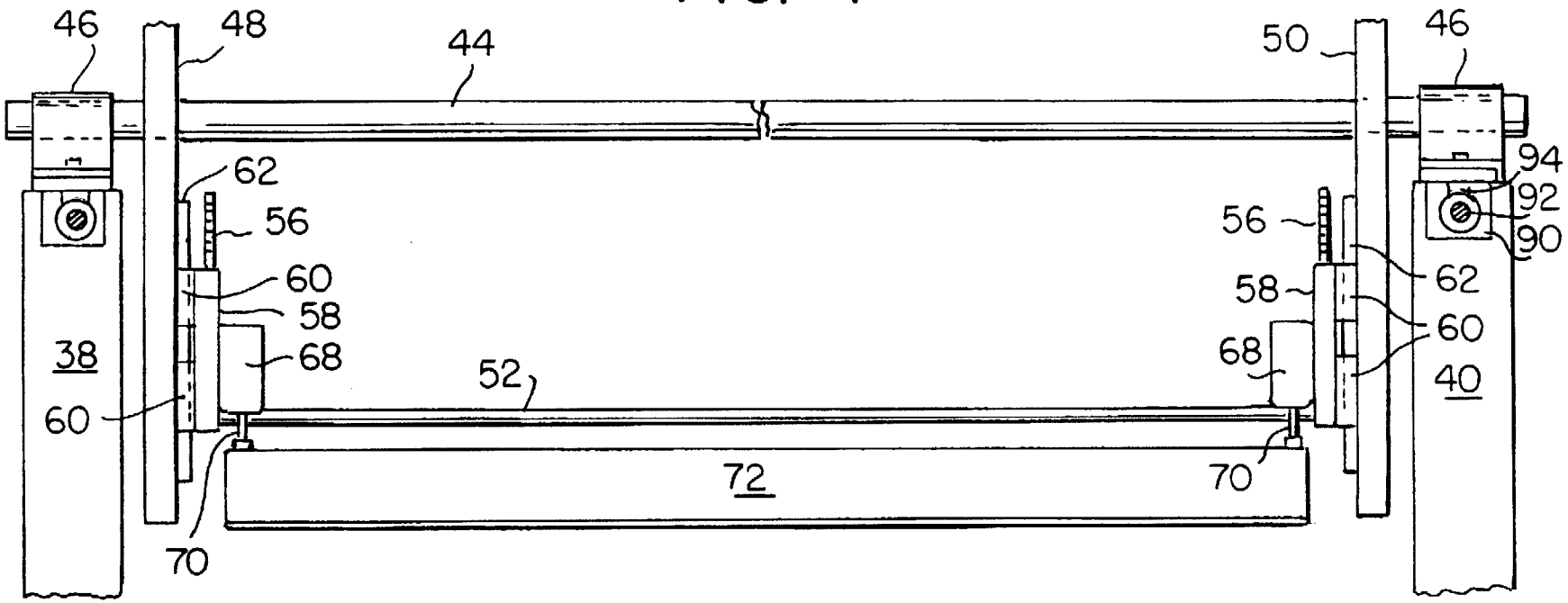
FIG. 4 is an end elevational view partly in section of the apparatus shown as taken on the line IV—IV in FIG. 2, the rotary blade cutter being omitted in this view.

The rotary frame 42 as seen from FIG. 4 is set between the inner side faces of the piers and comprises a pair of spaced apart end plates 48, 50, these plates carrying a plurality of circularly spaced rotatable web support elements 52 at the plate peripheries, at least a part of the web feeding course traversing these support elements as from location X in counterclockwise run to point Y. These support elements, e.g., can be cylindrical rollers. The feeding web 16 is supplied from a web stock source, i.e., the web forming machine.

The inner side faces of the end plates 48, 50 carry a number of components as now will be described, the components being the same on each end plate and descriptions of components on one end plate are to be understood as being the same for the other end plate. A holder bracket 54 is fixed to the end plate inside face and supports a power operated screw mechanism box 55 from which radially extends an advance/retract screw 56 that is connected with a mounting block 58. By rotating screw 56 in a given direction, the mounting block 58 will be moved radially toward or away from of the axis of shaft 44.

The mounting block 58 is carried to be slidable at the end plate inside face by fixing it at the mounting block inner face to a number of bearing slides 60 movable along rods 62 which rods are fixedly secured to the end plate inside face as shown in FIG. 4.

The mounting block 58 also carries at its outside face, a rotary blade cutter traverse unit 59, rotary blade cutter 64 and a track 66, the track spanning between both mounting blocks. As will be noted from FIGS. 1–4, the blade cutter traverse unit 59 and track 66 are fixed directly to the mounting plate 58 while the rotary blade cutter 64 is carried by a support arm 67 fixed to the mounting block so that the rotary blade cutter is a distance radially beyond the mounting block where it locates alongside a web contact shoe to be described shortly.

Figure 9:
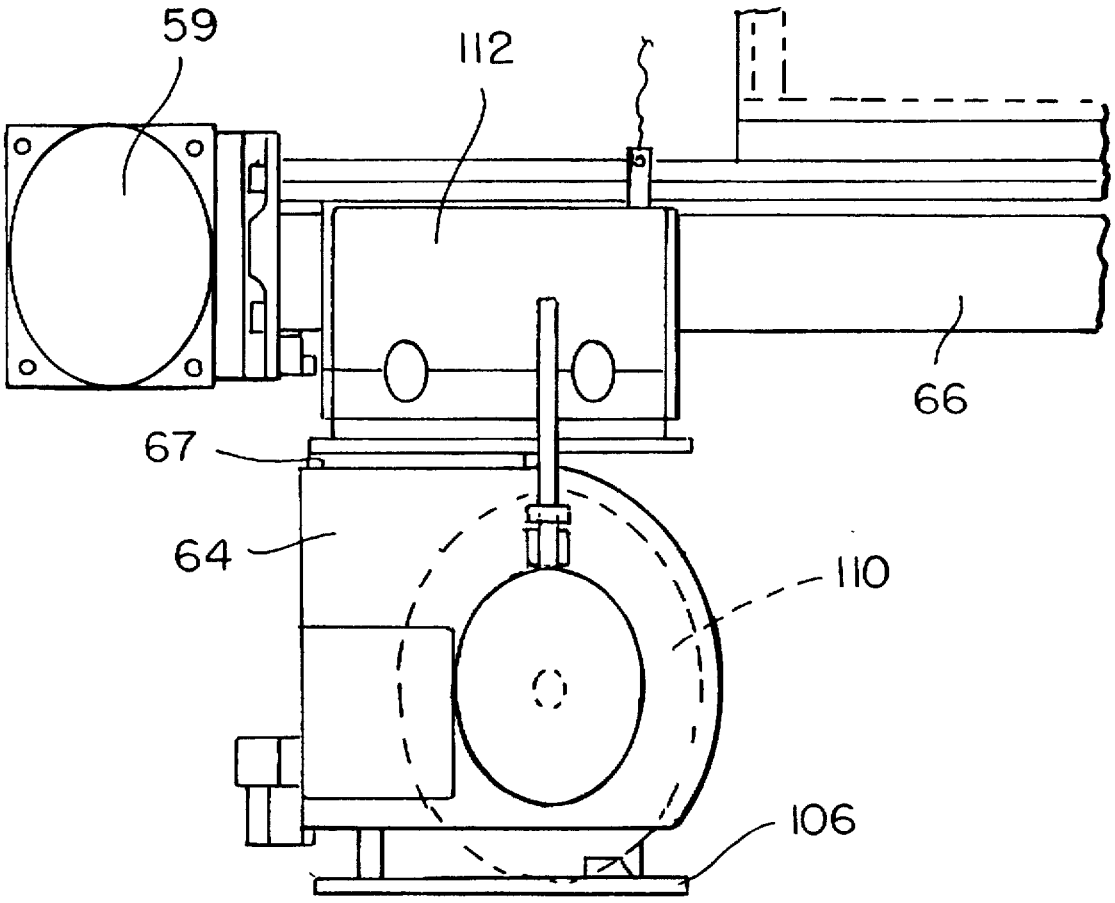
FIG. 9 is a fragmentary end elevational view showing of the arrangement depicted in FIG. 8.

FIGS. 8 and 9 show additional details of the rotary blade cutter 64 and its traverse unit 59, the latter being connected to a mounting block 58. Track 66 as is understood extends between the two mounting blocks associated with the two end plates 48, 50. A drive housing part 112 of the cutter 64 is attached to the track 66 and is movable thereon. Drive housing part 112 can be driven along the track carrying the cutter and its blade in longitudinal travel between the two extremes of the track. This is effected with an endless drive belt (not shown) in the track that has teeth in mesh with rack teeth (not shown) in housing part 112. Such type of drive arrangement is known in the art, the particular here used arrangement is that of an electric linear track assembly.

As seen in FIG. 9, a sensor 114 can be mounted at one extreme of the track run and be employed to signal cutter presence/absence from such location. This condition can be used in connection with control of cutter travel during the web cutting operation.

Also carried fixed at the mounting block 58 outside face is a power operated cylinder unit 68 which has a strokable rod 70. A web contact shoe 72 is fixed to a tip end of the rod 70. When the cylinder unit 68 is operated to stroke rod 70, the web contact shoe 72 will be moved radially toward and away from the mounting block 58. Such stroked movement of the web contact shoe occurs radially of shaft axis 44 and will be in addition to radial movement of the web contact shoe caused by radial movement of the mounting block itself. More discussion of web contact shoe movement will be given later in connection with description of the operation of the apparatus.

Figure 5:
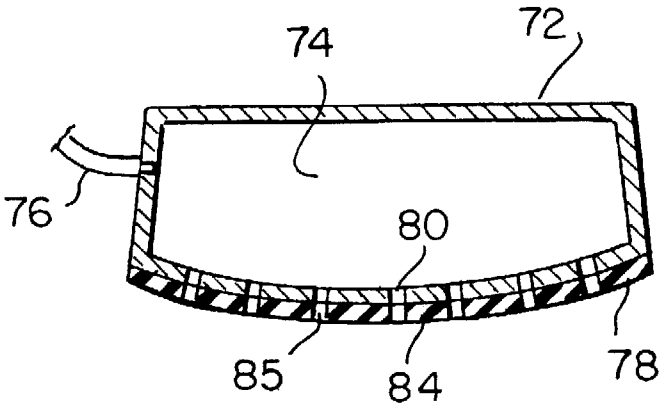
FIG. 5 is a transverse sectional view on enlarged scale of the web contact shoe.

As shown in FIG. 5, the web contact shoe 72 has a hollow interior 74 which is communicated to a source of vacuum by way of vacuum line 76 so that a condition of reduced pressure can be established in the web contact shoe. A lower exterior contact face part 78 of the web contact shoe is provided with passages 80 so that the reduced pressure condition in the shoe is present at the shoe surface that will contact the feeding web. Thus during the time the shoe is in contact with the web 16, the web will be caused to be held to the shoe surface by atmospheric pressure acting on the web against the shoe interior reduced pressure.

Figure 10:
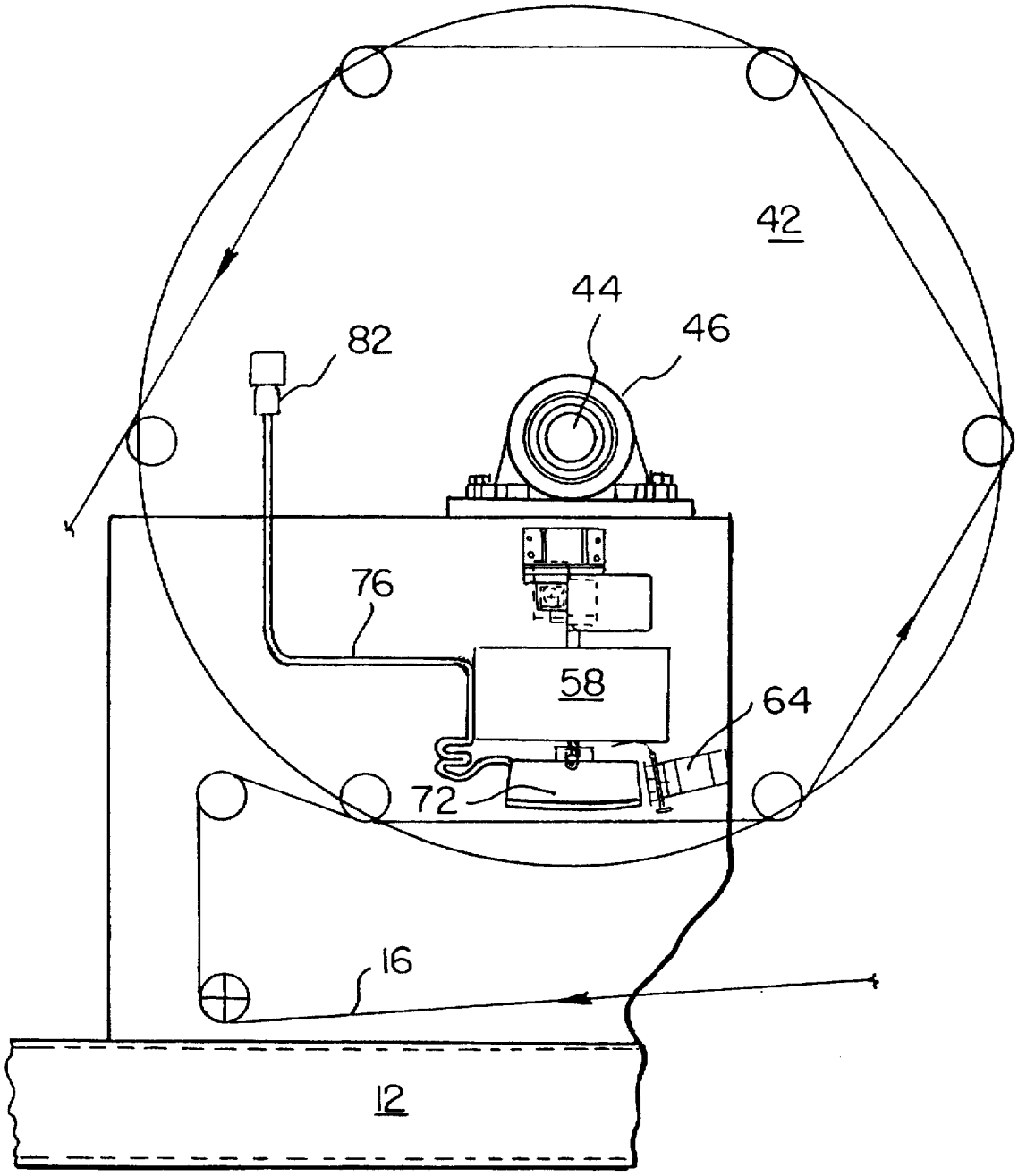
FIG. 10 is a fragmentary schematic showing of how a vacuum system can be embodied in the apparatus for maintaining a condition of vacuum in the interior of the web contact shoe.

FIG. 10 depicts one manner of establishing a condition of vacuum in the shoe. A vacuum system connection component 82 can be carried, e.g., on the rotary frame 42. Power for operating the component can be effected with a slip ring arrangement (not shown) to the rotary frame. Line 76 is provided with a flexible section part so as to take into account radial movement of web contact shoe 72.

To cushion contact of the feeding web 16 with the web contact shoe when contact between them is effected, the exterior contact surface of the shoe can be covered with a layer of cushioning material 84, the layer having passages 85 aligned with the passages 80 in the shoe structure to establish the vacuum condition at the exterior face of the layer 84. The layer 84 can be of various materials effective to the cushioning purpose being, for example, of rubber or of a synthetic, expanded foam.

Figure 7:
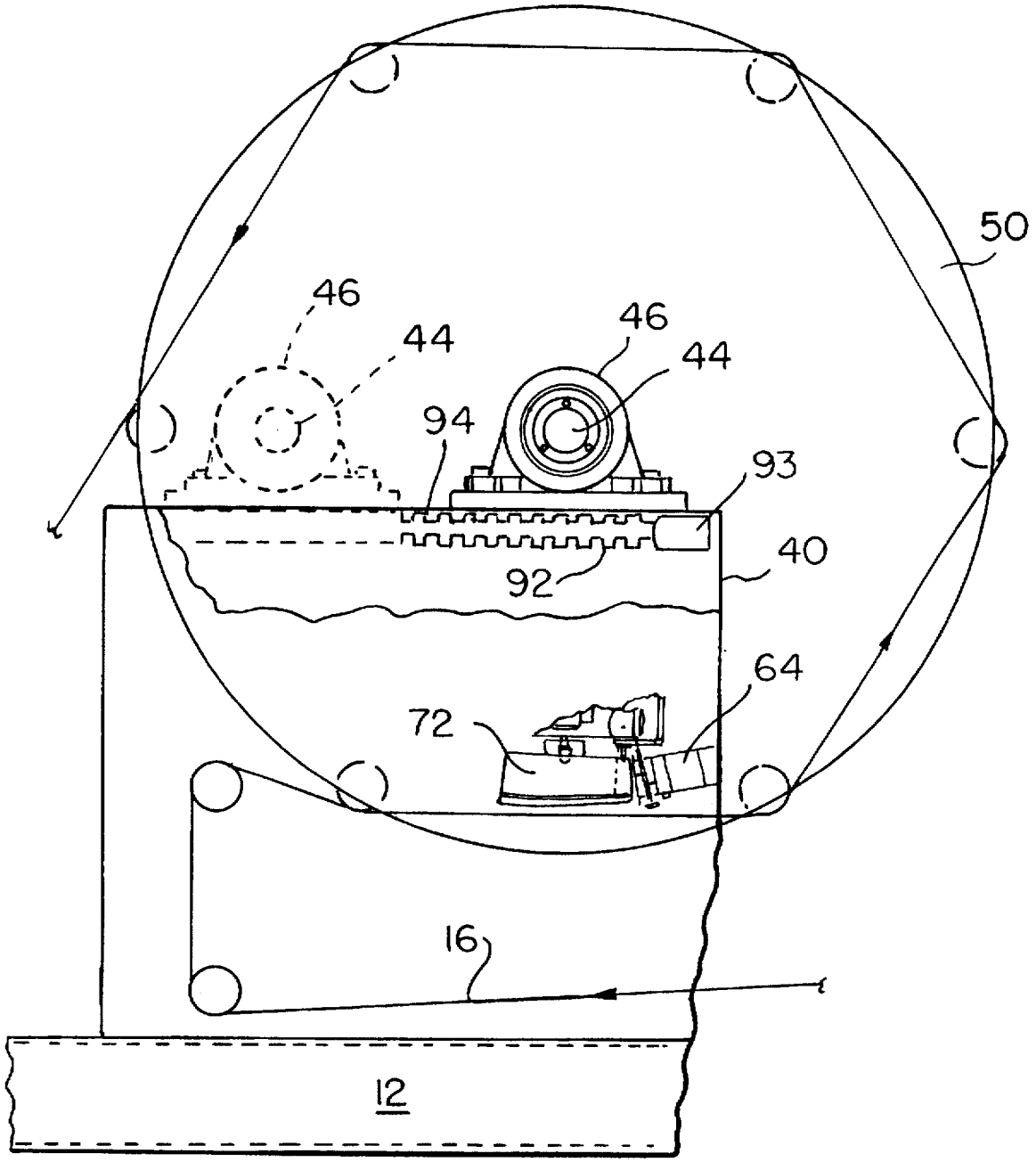
FIG. 7 is fragmentary schematic depiction showing of a feed screw arrangement used for moving the rotary frame between its maximum and minimum operating positions.

During operation of the apparatus, it is necessary that the rotary frame 42 be slid toward and away from the winding station W. One means for effecting such now will be described and with reference to FIGS. 4 and 7. Piers 38, 40 can be slotted at the top as at 90, and located in each slot 90 will be power driven screws 92 which mesh with toothed racks 94 carried at the underside of the bearing blocks 46. By operating the screws 92 on each pier 38, 40, the bearing blocks can be moved from the FIG. 7 solid line position to the dashed line position and vice versa. Since the rotary frame 42 is journaled in the bearing blocks 46 it will have the same movement. This rotary frame movement also can be seen by reference to the FIGS. 1 and 2 showings.

Operation of the apparatus is now described. As shown in FIG. 1, the feeding web 16 feeding from the source enters dancer roll unit 100 of known construction and used for the purpose of assuring uniform tension in the feeding web. The web course passes below the rotary frame 42 and makes transition upwardly around guide rollers 102 and makes a reverse course run onto the rotary frame at location X, the feeding web coursing around the rotary frame on support elements 52 in counterclockwise travel until it passes off the rotary frame at location Y onto the winding roll 104.

In the FIG. 1 depiction, the winding roll 104 is at about the desired full wound condition, so it is required to move that roll away from the winding station W. This is done by indexing the winding unit 14 to move the still winding roll 104 in clockwise travel to the position shown in FIG. 2 and adjunct which, an empty core 18 E which was at a standby station is moved to the winding station W.

With the empty core 18 E positioned at the winding station W, the rotary frame 42 will be moved from the position it is in FIG. 1 to the position shown in FIG. 2 so that the periphery of the rotary frame will be closely adjacent a periphery of the empty core 18 E at the winding station.

With movement of the rotary frame 42 leftwardly to the FIG. 2 positioning thereof, the mounting 58 block and the components thereon including the web contact shoe 52 still will be located in the radial position shown in FIG. 1. Shaft 44 and, hence, the rotary frame will then be rotated at a speeded up rate to provide the rotary frame with a periphery speed which is one corresponding to the line speed of the feeding web 16 so that there will exist no differential between the two speeds.

With the rotary frame peripheral speed matched to that of the feeding web, the web contact shoe 72 can be moved into contact with the feeding web so that the web will be held by the vacuum effect at the contact surface of the shoe. To effect this movement, the screw member 56 will be operated to move the mounting block 58 radially away from the axis of shaft 44 until shoe/web contact is effected. This contact is when the web contact shoe is in the position depicted in FIG. 2.

When the web contact shoe is in the FIG. 2 contact position, the shoe, mounting block 58 and the components carried thereon including cutter 64, are rotating in tandem movement with the feeding web. The next step is to effect cutting of the feeding web. First though, it is important to note that the cutter 64 is positioned in advance of the web contact shoe in the direction of rotary frame rotation so that following web cutting, the leading end of the cut web upstream of the cut location will be retained held by the contact shoe.

In the instance where the feeding web course around the rotary frame is counterclockwise, the cutter 64 to be in advance of the web contact shoe will be at the right side of the contact shoe as seen in FIGS. 1–3. If the web feeding course and the rotary frame rotation were to be in clockwise direction, a second cutter (not shown) is positioned to left side of the web contact shoe in order to be in advance of the contact shoe.

The selection of counterclockwise/clockwise direction of web travel depends on which face of the feeding web is to be at the outermost side of a wound core. An ultimate user may, for example, want a particular fabric web side to feed off a wound core in side orientation opposite that of the FIGS. 1–3 condition thereby requiring that winding be effected with a feed and rotary frame rotation in a clockwise direction. By providing two cutters as noted above the apparatus can be used in a bidirectional winding operation.

In such case, the feeding web 16 instead of advancing leftwardly from the dancer roll 100, would course upwardly at the right side of rotary frame 42 and then leftwardly across the top of the rotary frame. It then would be directed downwardly and then rightwardly from above the rotary frame to make entrance on to the rotary frame at about the eleven o'clock position.

For counterclockwise web and rotary frame travel, the cutter 64 would be to the right of the web contact shoe (FIGS. 1–3), whereas, for cutting clockwise feeding web travel on the rotary frame, the cutter would be to the left of the contact shoe.

Figure 6A:
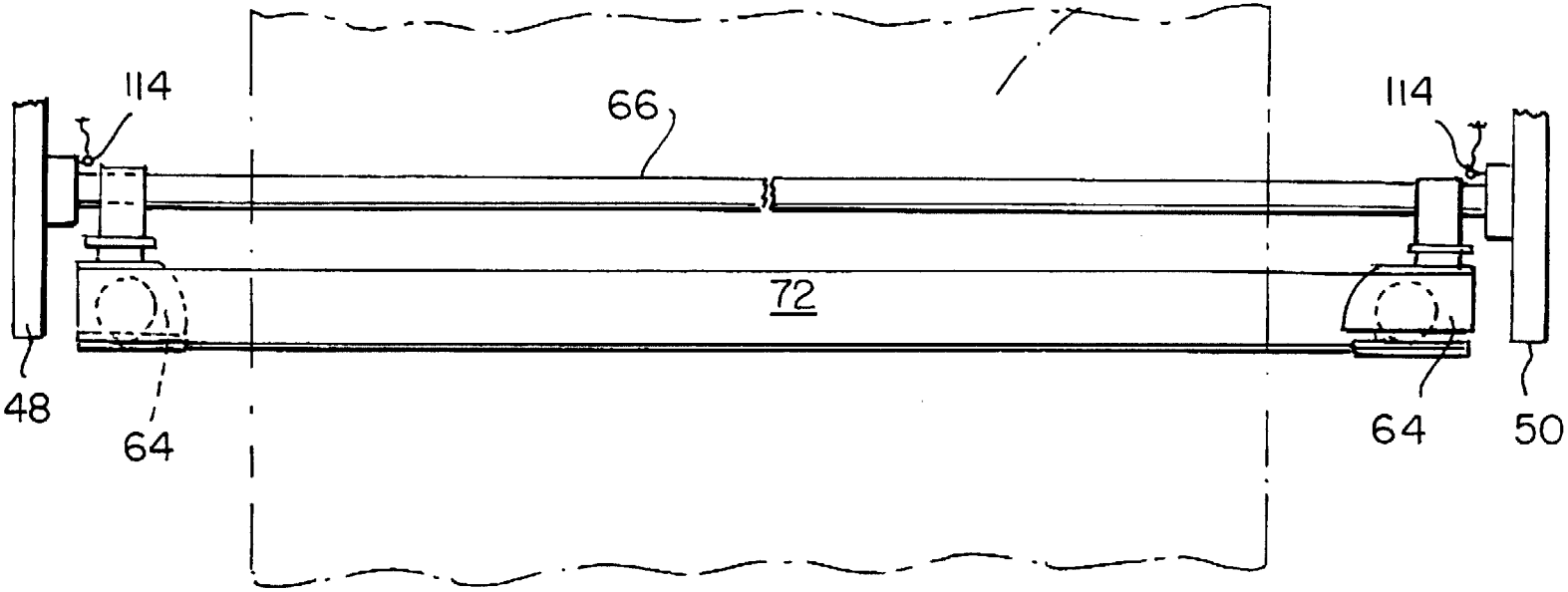
FIG. 6A is a schematic depiction in elevation of mounting of two rotary blade cutters on separate tracks for effecting web cutting with an appropriate one of said blade cutters when the rotary frame is moving in a counterclockwise direction and effecting cutting with the other when the rotary frame is moving in a clockwise direction giving the apparatus bidirectional winding capacity.
Figure 6B:
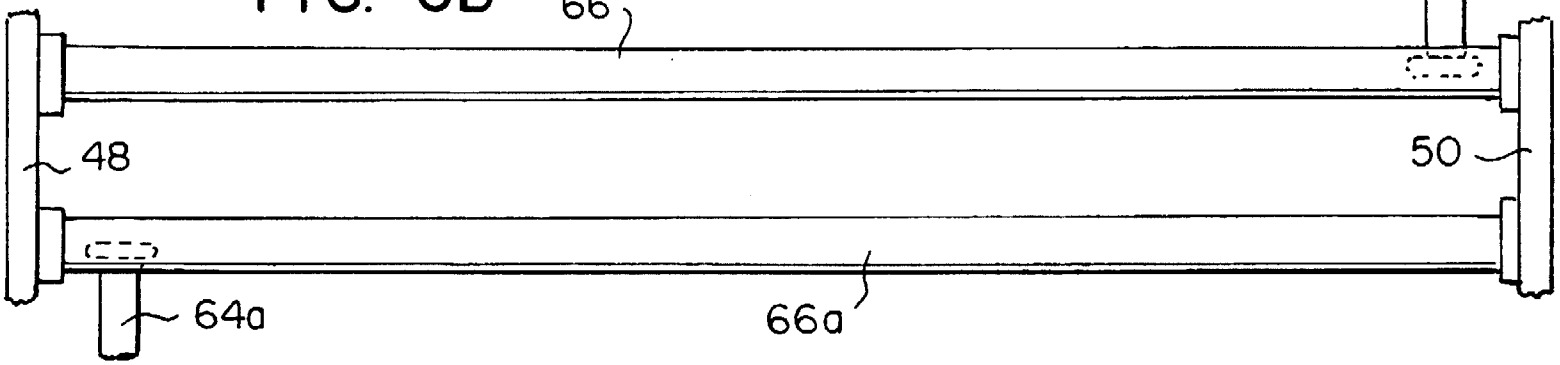
FIG. 6B is a schematic depiction in plan view of the rotary blade cutter mounting shown in FIG. 6A.

FIGS. 6A and 6B show an arrangement where two cutters 64, 64*a* are provided to operate on separate tracks 66, 66*a*, the particular cutter that operates during a cut and transfer cycle being dependent on the direction of web and rotary frame travel.

There could arise a circumstance in use of the apparatus where it is desirable that crosswise cutting of the web be accomplished more rapidly than is effected with a single operating cutter moving from end to end of the track. To achieve this two cutters could be mounted on a single track and operate from respective ends to make the cut. With such arrangement, one cutter could initiate its cutting an instant before the other and travel across the feeding web to substantially mid-distance, and start its retract travel. The other cutter lagging in its start of travel would cut toward the mid-distance and by the time it arrived at that location the first cutter is cleared in the retract direction so the second cutter could over travel the mid-distance point by a short length to assure complete web severance occurs and then it would retract.

Returning now to the cutting of the web 16, when the rotating rotary frame 42 is in at the FIG. 2 positioning, i.e., when the web contact shoe (with the web held thereagainst) is in six o'clock position, the cutter 64 will be operated to drive it along track 66 and at the same time rotate its circular cutting blade at high speed. Cutting of the web will be carried out as the web contact shoe rotates to about the twelve o'clock position at which point web cutting will be completed. The cut line will be a substantially straight line crosswise to the web, this being because during cutting the circular cutting blade 110 is moving in tandem with the feeding web. The cutter 64 carries as part thereof, an anvil 106, which supports the web adjacent the circular cutting blade during the course of cutting.

Upon completion of the cutting, the cylinder unit 68 will be operated to stroke the web contact shoe 72 a distance radially away from the mounting block 58. This will project the web contact surface of the contact shoe and the web leading end held thereagainst slightly beyond the periphery of the rotary frame 42 so that the web leading end is positioned to strike or make contact with the periphery of the empty core 18 E at the winding station W when the web contact shoe is in about the two o'clock position.

As seen from FIG. 3, when the web contact shoe 72 passes closely adjacent empty core 18E, the web leading end strikes the empty core 18 E and since at least some of the core periphery may carry adhesive such as a double face adhesive tape 108, the web leading end will become adhered to the empty core periphery, thereby effecting web transfer thereto, and winding of the feeding web ensues.

After passing the winding station, web transfer having been made, the cylinder unit 68 retracts, and the screw 56 is operated to retract the mounting block radially toward the axis of shaft 44. The rotary drive for the rotary frame 42 can be terminated and the mounting block kept at the radial positioning shown in FIG. 1 to await the next cycle of filled core/replacement core operation.

Also at this time, the rotary frame 42 will be moved rightwardly to the FIGS. 1 and 2 position by operating the power driven screws 92 thereby to clear the rotary frame from the winding station WS vicinity so that windings being made on core 18E can build up without interference or obstruction from the rotary frame.

Following cutting of the feeding web, the trailing web end resulting from the cut is taken up on the filled winding roll 104 as seen in FIG. 3.

FIG. 11 shows a control system for controlling operation of the apparatus. Central processing unit 120 is employed to receive and generate control function signals. Thus it effects control of motor 122 for rotating shaft 24 of the winding unit 14 as needed for moving a filled core away from the winding station and locating an empty core at that station. In like manner, CPU 120 controls motor 124 for rotating rotary frame shaft 44, this being a significant control function to bring the rotary frame periphery up to speed match web speed. Condition of sensors 114 associated with the rotary cutter also can be acquired by the CPU for generation of control function. Operation of the winding motors 26, power operated screw 92, cylinder 68 and screw mechanism box 55 also is effected by the CPU.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in appended claims.

What is claimed is:

1. Apparatus for transferring a web moving in a guided and supported web feeding course to and winding as a web stock on a first takeup core to a second empty takeup core when the web stock on the first core is at a full wound condition, said apparatus comprising a winding unit having means for rotatably supporting said first takeup core at a winding station and said second takeup core at a standby station, said rotatably supporting means including means to rotate said first and second takeup cores independently of each other, a web cutting and transfer unit, said web cutting and transfer unit including a rotary frame and a plurality of web support elements spaced about a periphery of said rotary frame, at least a part of said web feeding course traversing said web support elements, said rotary frame being rotatable about an axis transverse to said at least a part of said web feeding course, said web cutting and transfer unit further including web cutting means and a mounting on said rotary frame carrying said cutting means, said mounting carrying a web contact shoe, said web cutting means being carried on said mounting adjacent said web contact shoe in a position leading the contact shoe in a rotation direction of the rotary frame, said mounting being mounted to move radially toward and away from said axis to correspondingly move said web contact shoe into and out of contact with said web as it traverses said web support elements and correspondingly to move said cutting means into and out of a web cutting position, said cutting means further being carried on said mounting so as to move in a cutting travel course extending parallel to said axis and between opposite ends of said rotary frame, said winding unit including means for displacing the first takeup core from the winding station when the web stock thereon is at full wound condition and for advancing the second empty takeup core from the standby station to the winding station, said web cutting and transfer unit being movable between first and second operating positions thereof, said at least a part of said web feeding course when said web cutting and transfer unit is in first operating position being located remote from said winding station, said at least a part of said web feeding course when said web cutting and transfer unit is in second operating position passing closely adjacent a periphery of a said empty takeup core at said winding station, means for rotating said rotary frame to a speed wherein a periphery speed of the rotary frame is substantially the same as a line speed of the feeding web so that when said mounting is moved radially away from the rotary frame axis to move the web contact shoe into contact with said web, said contact shoe and the cutting means carried on said mounting move in tandem with said web along said at least a part of said web feeding course, an interior of said web contact shoe being connected with a source of vacuum, said web contact shoe having an exterior contact face communicating with the web contact shoe interior so that the feeding web is held against said web contact shoe exterior face by influence of the vacuum, said cutting means when in cutting position and moved in cutting travel from one rotary frame end to the opposite rotary frame end cutting the feeding web crosswise to the said at least a part of said web feeding course leaving a web trailing end on a downstream part of the feeding web and a web leading end on an upstream part of the web, said web leading end being held against the web contact shoe contact face, and a stroking member carried on the mounting and connected to the web contact shoe for stroking the web contact shoe radially outwardly from the mounting when the web contact shoe passes proximal a periphery of said empty takeup core to move the web leading end into contact with a periphery part of said takeup core thereby to transfer the web leading end to the takeup core, said stroking member being operable to return stroke the web contact shoe radially toward the mounting following transfer of the feeding web leading end to the takeup core.

2. The apparatus of claim 1 in which the web cutting means comprises at least one rotary circular blade cutter.

3. The apparatus of claim 2 in which the mounting supports a track extending parallel to the rotary frame axis, said rotary circular blade cutter being movable slidably along said track.

4. The apparatus of claim 1 in which movement of the mounting radially of the rotary frame axis is effected with advance/retract screw means connected to the mounting.

5. The apparatus of claim 1 in which the rotary frame comprises a pair of spaced apart end plates, the web support elements extending between said end plates and being rotatably mounted at the periphery of each of said end plates.

6. The apparatus of claim 5 in which the support elements are cylindrical rollers.

7. The apparatus of claim 5 in which the mounting is carried at an inside face of one of said end plates, there being an actuator fixed to said one end plate and operatively connected to said mounting for moving said mounting radially toward and away from said axis.

8. The apparatus of claim 7 in which the actuator is a screw mechanism having an advance/retract screw engaged with said mounting.

9. The apparatus of claim 7 further comprising another mounting carried at an inside face of a second of said end plates, said other mounting being operable to move radially toward and away from said axis, said web contact shoe being carried by both the mounting carried on said one end plate and said other mounting, the web cutting means comprising a track extending parallel to said axis, opposite ends of said track being supported by the mountings carried on said end plates, at least one rotary circular blade cutter mounted on said track, and another stroking member carried on said other mounting and connected to the web contact shoe.

10. The apparatus of claim 1 in which the exterior face of the web contact shoe is covered with a material layer for cushioning contact between the said exterior face and the feeding web, the said material layer having openings passing therethrough for communicating with the web contact shoe interior.

11. The apparatus of claim 10 in which the material layer is of rubber.

12. The apparatus of claim 10 in which the material layer is of a synthetic foamed material.

13. A method for transferring a web moving in a guided and supported web feeding course traversing around a rotary frame and passing therefrom to and winding as a web stock on a first takeup core at a winding station proximal a periphery of said rotary frame to a second empty takeup core when the web stock on the first core is at a full wound condition, said method comprising displacing the first takeup core from the winding station while maintaining web winding thereon and moving the empty takeup core to the winding station, rotating the rotary frame to provide the rotary frame with a speed at the periphery thereof that matches a line speed of the moving web so that a rotary cutter and a web contact shoe carried on the rotary frame and positionable proximal the said rotary frame periphery move in tandem with said web, moving the web contact shoe into contact with the web so that the web is held to a face of said web contact shoe under the influence of a condition of vacuum present at said face, operating the rotary cutter to move in a cutting travel course extending parallel to the axis of rotation of the rotary frame to cut the moving web along a cutting course crosswise to a direction of web movement and with the cutter positioned in advance of the position of the web contact shoe so that a web leading end of the web of a web part upstream of the cutting course is held at the face of the web contact shoe, and advancing the web contact shoe radially of the rotary frame to project the web contact face thereof beyond the rotary frame periphery so that as the web contact shoe contact face thereafter passes proximal an outer periphery of the empty takeup core, the web leading end contacts the takeup core periphery thereby to effect transfer of a feeding of the upstream web part to the takeup core for winding thereon.

14. The method of claim 13 in which the rotary cutter is a circular blade cutter.

* * * * *